United States Patent [19]

Büch

[11] Patent Number: 4,552,276

[45] Date of Patent: Nov. 12, 1985

[54] DRINKING VESSEL HAVING A HOLDER

[76] Inventor: Wolfgang Büch, Dorfstrasse 4, D-2359, Kisdorf, Fed. Rep. of Germany

[21] Appl. No.: 586,357

[22] Filed: Mar. 5, 1984

[30] Foreign Application Priority Data

May 18, 1983 [DE] Fed. Rep. of Germany ... 8314583[U]

[51] Int. Cl.[4] ..... B65D 21/02

[52] U.S. Cl. ..... 215/100 A; 220/85 H; 294/31.2; 294/32

[58] Field of Search ..... 215/100 A; 220/85 H, 220/94 R, 96; 294/31.2, 32; 222/465 R; D7/70

[56] References Cited

U.S. PATENT DOCUMENTS 2,128,466 8/1938 Machotka ..... 294/32 X 3,056,622 10/1962 Hilderbrandt, et al. ..... 294/31.2

3,481,639 12/1969 Lawrence ..... D7/70 X 3,596,795 8/1971 D'Ercoli ..... 220/85 H X

*Primary Examiner*—Steven M. Pollard

*Attorney, Agent, or Firm*—Gregory J. Nelson

[57] ABSTRACT

A drinking vessel is made up of an inner glass beaker part and a holder placed round it for lifting the beaker to the mouth. The holder is made up of a ring and a handle formed thereon in a single piece of material. The ring has the function of elastically gripping the side wall of the beaker. The handle has two rests which are kept elastically pressed against the beaker wall at two different levels where the conical beaker has two different diameters. The upper rest has a ledge for resting against the top rim of the beaker and locking the beaker in position in the holder axially.

6 Claims, 3 Drawing Figures

DRINKING VESSEL HAVING A HOLDER

BACKGROUND OF THE INVENTION

Figure 1:
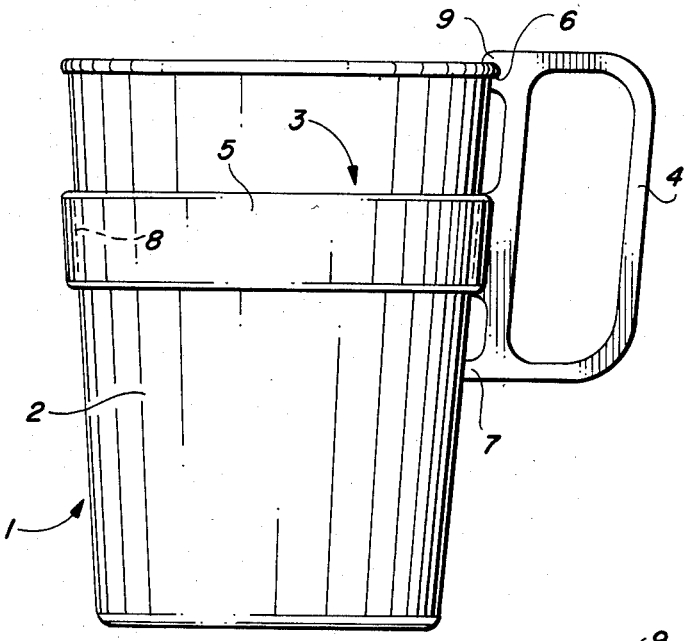

The present invention is with respect to drinking vessels, and more specially to such a vessel with a conical beaker part and holder that has a handle placed on a ring running around the beaker.

Drinking vessels on these lines are known in some parts of the world as tea glasses. The holder, that is made of different material to the beaker, is used for picking up the vessel and putting it down again while at the same time functioning as insulation between the glass beaker heated by the tea on the one hand and the handle part on the other so that the handle keeps cool.

A marked shortcoming of such known drinking vessels is that the holder made up of the handle and the ring is not locked in relation to the beaker so than when put at a certain slope there is a chance of the glass slipping out of the holder and being damaged or smashing to pieces. A further shortcoming is to be frequently seen in the fact that expansion of the ring is caused by the heat of the drink so that there is no longer any gripping effect of the holder on the beaker, that is to say between the ring and the glass, and this is again likely to be a reason for the beaker slipping out of the ring of the holder. Lastly, known designs of glasses have the shortcoming that the glass is gripped relatively low down by the holder so that the overall center of gravity (the center of gravity of the glass and the holder) is much higher up than the ring and this makes the drinking vessel hard to handle.

In the prior forms of such drinking vessels of the sort noted herein the beaker is to be simply lowered into the holder to put it in place and the beaker is then kept in the holder by gravity only. When the drinking vessel is be used in places where there is a chance of the vessel being moved so that the force of gravity is not always acting in the same direction in relation thereto (for example in trailers, on board ship or the like) or in cases where the drinking vessel has to be so designed that is very simply handled, as for example in a nursery, it is then necessary for the drinking vessel to be so designed that it is a safe, readily used and readily transported article for everyday use.

SHORT OUTLINE OF THE INVENTION

One purpose of the present invention is to make a design of drinking vessel of the sort in question such that the holder is firmly joined to the drinking beaker part so that the beaker is kept positively fitted in the holder even when acted upon by heat or when its angle in relation to the force of gravity is changed.

Another purpose of the invention is making the design such that the holder may be produced using simple means and may be readily exchanged for another form of holder.

In keeping with a still further object of the invention, the structure of the holder is to be designed for the beaker to be safely and readily held.

In keeping with the invention the holder has as its main parts a ring for fitting around the beaker (which is more specially conical in form) and a handle with at least one rest, the holder being made with means for preloading or prestressing said rest so that same is kept pressed against the outer face of the side wall of the beaker. Further, useful developments of the invention are noted in the dependent claims.

The prestressing force is produced by the rest being made with a smaller diameter than at least part of the beaker so that when it is put on the beaker by pushing along the wall thereof the diameter position of the rest is elastically increased. This spring mounting or prestressing effect is responsible for the ring fitted round the beaker making contact with a large part of its inner face with the outer face of the beaker so that there is then no chance of the holder slipping in relation to the beaker if this is not desired. The top rest placed at the top rim of the beaker has a hook or ledge gripping round over the rim so that there is no chance of the beaker slipping out of the holder even if the radial size of the ring is increased by thermal expansion.

In place of a conical beaker, the holder may be used on a cylindrical beaker with a shoulder, in which case the ring of the holder is kept pressed against the shoulder when the holder has been pushed onto the beaker, it then functioning with the rim ledge or hook in axially locking the beaker in place.

An account will now be given of some preferred working examples of the invention as seen in the figures.

LIST OF THE DIFFERENT VIEWS OF THE FIGURES

FIG. 1: is a side view of the drinking vessel in keeping with the present invention as seen from the side.

Figure 2:
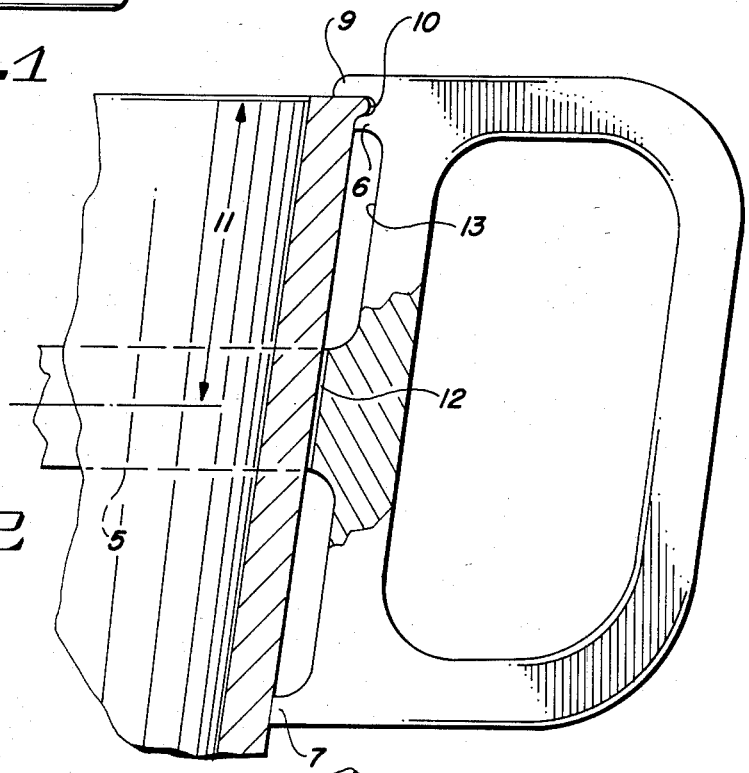

FIG. 2: is view of part of the drinking vessel of FIG. 1.

Figure 3:
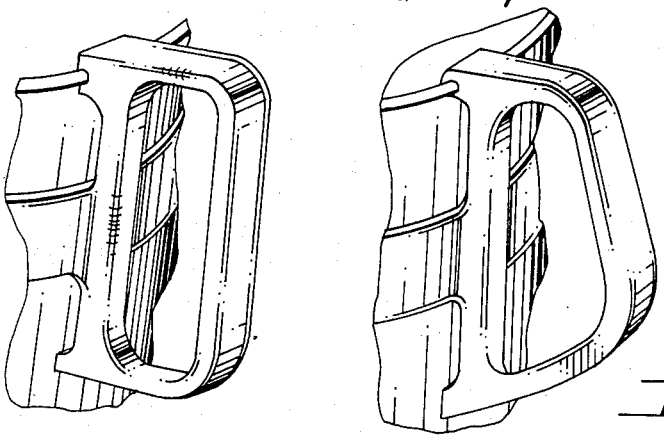

FIG. 3: is a view of two further working examples of the handle in keeping with the present invention.

DETAILED ACCOUNT OF THE WORKING EXAMPLES OF THE INVENTION

The main parts of the drinking vessel, generally referenced 1, to be seen in FIG. 1 are the conical beaker 2 and the drinking vessel holder generally referenced 3, same being made up of the handle 4 and the ring 5.

The holder 3 is to be seen in the fitted condition with the handle 4 supported by way of the two rests or heads 6 and 7 resting against the outer face of the beaker wall at two different levels that is to say diameters thereof. The force produced by the prestressing or loading effect takes effect by way of the ring at the point 8, where the force is strongest, on the beaker wall, said force decreasing along the circumferential direction so that at the join between the ring and the handle the force is zero, the ring because of this being clear of the outer face of the beaker (see FIG. 2, position 12).

As will be seen from FIG. 2, the ring 5 placed round the beaker is joined with the handle towards the middle of the handle's side 13 (running parallel to the beaker side wall), because it is at this point that the maximum preloading effect or spring force may be transmitted by way of the ring to the beaker.

Furthermore there is a ledge or hook 9 and the top end of the handle 4 elastically or prestressingly gripping round onto the top rim of the drinking vessel.

Because of the ledge 9 and the conical form of the ring, the ring will be tightly kept in position resting against a large area of the circumference after assembly so that the beaker will be fully locked axially in the holder. Putting it differently, both on picking up the complete drinking vessel and on putting it down again the beaker is kept fully in place in the holder.

For the beaker to be efficiently kept in place by the ledge it is not always necessary to have a bead 10 as marked in FIG. 2 as is frequently present on machine-made glasses and in fact the beaker may be made without such bead or be made of a different material to glass.

The drinking vessel holder is made of an elastic synthetic resin making it simple to put it on and take off and furthermore keeping up the elastic or prestressing effect in gripping the beaker for a long working life.

The handle is in the form of a loop like a letter D so that it has an opening. The design of the handle makes it possible for the drinking vessel to be safely gripped even when the beaker is full and it furthermore becomes possible for the drinking vessel to be fixed in a given position, as for example in a trailer or on board ship, by a running a piece of thread or a stick through it.

The handle and the ring making up the holder are made in one piece of material. In this respect the reference distance 11 (see FIG. 2) may be kept constant, unlike making the ring and the handle separately, in which case the distance 11 will not always be the same and there is a chance of the join between the handle and the ring working loose.

Further useful developments of the handle are to be seen in FIG. 3. The handle openings in this case make it possible for more than one finger to be put through the handle.

I claim:

1. A holder for a drinking vessel having a generally circular exterior at any location and an open top with a lip extending circumferentially at the said top, said holder comprising:

(a) a ring member having an opening adapted to extend circumferentially about an intermediate section of the exterior of said vessel;

(b) a handle integrally formed with said ring and adapted for grasp by the user, said handle including upper and lower spaced-apart rests, said upper rest engaging said rim and said lower rest engaging the said vessel body at a location below the said ring, at least one of said rests having a diameter less than the corresponding engaged portion of the vessel whereby a prestressing force is applied on the vessel wall when said one rest is placed in engagement with the vessel.

2. The drinking vessel as claimed in claim 1 wherein said vessel has a generally axially tapering exterior and said ring defines a generally corresponding tapered opening.

3. The drinking vessel as claimed in claim 1 wherein said handle is in the form of an open loop with an upright side thereof nearest said beaker side wall, there being such a relation between the length of the said upright side and the average diameter of said ring that when said ring is in place on said beaker a top one of two such rests is at a top rim of the said beaker.

4. The drinking vessel as claimed in claim 1 wherein said top rest has a ledge for prestressingly gripping the said rim.

5. The drinking vessel as claimed in claim 1 wherein said handle and said ring are made of synthetic resin.

6. The drinking vessel as claimed in claim 1 wherein said handle is made in the form of a loop.

* * * * *